United States Patent [19]

Matsumoto et al.

[11] Patent Number: 4,510,662

[45] Date of Patent: Apr. 16, 1985

[54] APPARATUS AND A METHOD FOR FORMING SPACE SECTIONS IN A SLIDE FASTENER CHAIN HAVING COUPLING ELEMENTS IN THE FORM OF CONTINUOUS COIL

[75] Inventors: Masao Matsumoto; Shigeru Imai, both of Toyama, Japan

[73] Assignee: Yoshida Kogyo K. K., Tokyo, Japan

[21] Appl. No.: 452,614

[22] Filed: Dec. 23, 1982

[30] Foreign Application Priority Data

Dec. 29, 1981 [JP] Japan ..... 56-197537[U]

[51] Int. Cl.[3] ..... B21D 53/50; A41H 37/06

[52] U.S. Cl. ..... 29/408; 29/33.2; 29/770

[58] Field of Search ..... 29/408, 410, 33.2, 766, 29/770

[56] References Cited

U.S. PATENT DOCUMENTS

| | | | |
|---|---|---|---|
| 3,456,328 | 7/1969 | Wasko | 29/33.2 |
| 3,490,133 | 1/1970 | Glindmeyer | 29/33.2 |
| 3,863,323 | 2/1975 | Kakamatsu | 29/33.2 |
| 4,232,438 | 11/1980 | Takahashi | 29/770 |
| 4,404,722 | 9/1983 | Shimai | 29/33.2 |

FOREIGN PATENT DOCUMENTS 2074923 11/1981 United Kingdom .

*Primary Examiner*—Mark Rosenbaum
*Assistant Examiner*—Steven E. Nichols
*Attorney, Agent, or Firm*—Hill, Van Santen, Steadman & Simpson

[57] ABSTRACT

The present invention concerns a slide fastener making machine designed to produce space sections of required span devoid of coupling elements at predetermined intervals in the interengaged slide fastener chain and a method for the same.

The present apparatus includes: die means facing the fastener tapes for supporting the slide fastener chain horizontally; punch means disposed on the coupling elements side and being reciprocably movable toward the coupling element, said punch means having at the end surface a pair of laterally spaced apart cutting edges for cutting the upper leg portion of the pair of interengaged coupling elements at the connecting reversed portion side of the sewing thread and a gripping projection disposed centrally between the pair of the cutting edges for pressing the upper leg portions adjacent the interengaging head portions of the interengaged coupling elements; ejector means disposed in the die means reciprocably movable toward the gripping projection of the punch means, said punch means being upwardly movable in response to the upward movement of the ejector means while the upper leg portions adjacent to the interengaging head portions of the interengaged coupling elements is gripped between the edge of the ejector means and the gripping projection of the punch means; and means for holding the pair of fastener tapes. The coupling elements cut by the cutting edges or the dismembered coil fragments are suitable flattened by the gripping projection of the punch and the ejector so that they are released of the clinching tension of the sewing thread and get loose enough to be pulled out easily.

4 Claims, 8 Drawing Figures

APPARATUS AND A METHOD FOR FORMING SPACE SECTIONS IN A SLIDE FASTENER CHAIN HAVING COUPLING ELEMENTS IN THE FORM OF CONTINUOUS COIL

FIELD OF THE INVENTION

The present invention relates generally to an apparatus and a method for making slide fasteners, and more particularly to an apparatus and a method for forming space sections devoid of coupling elements having a predetermined length at predetermined intervals in an elongate slide fastener chain having interengaged coupling elements in the form of continuous coil.

BACKGROUND OF THE INVENTION

The coupling element in the form of continuous coil is made of synthetic resin and comprises an interengaging head portion, a pair of upper and lower leg portions and a connecting reversed portion. Each of a pair of the coupling elements is attached along one edge of the fastener tape by sewing thread passing through the fastener tape at the points between each two loops of the coupling element.

A number of apparatuses for the purpose described above are known in which space sections devoid of coupling elements are formed in the slide fastener chain. Such prior art is exemplified by Japanese laid-open patent application No. 56-156104 (corresponding to BG Public Disclosure No. 2,074,923A, publicly disclosed on Nov. 11, 1981).

In this prior apparatus, as shown in FIG. 1–4, the slide fastener chain is supported on the die 21 so that the interengaged coupling elements occupy the lower position. The punch 12 having a cutting edge 10 is lowered from the upper position or from the fastener tape side to the interengaged coupling elements 14 through the space between the opposite fastener tapes 20 so that the cutting edge 10 cuts the lower leg portion of the interengaged coupling elements 14 on the interengaging head portion side of the sewing thread 18. Then, the ejector 16 is elevated from the coupling element side toward the upper leg portion of the coupling elements 14 so that the interengaged portion of the interengaged coupling elements 14 is held between the cutting edge 10 and the ejector 16. After that, the ejector 16 and punch 12 are elevated synchronously while holding the interengaged coupling elements 14 therebetween so that the coupling elements 14 are pulled away from or removed from the sewing thread 18, and thus from the fastener tapes 20. However, in this prior apparatus, the coupling elements 14 are not pulled away from the sewing thread 18 and remain on the fastener tape 20 if the grip of the coupling elements 14 by the punch 12 and the ejector 16 is insufficient or loose, or the sewing thread 18 is broken due to the excessive force for pulling the coupling elements 14 away from the sewing thread 18 if the grip of the coupling elements 14 is too tight, since (i) only the lower leg position of the coupling element 14 is cut off, and its cut position is on the interengaging head portion side of the sewing thread 18, (ii) the coupling elements 14 cut off at the lower leg portion are gripped on the interengaging head portion side of the sewing thread 18, pulled away from the sewing thread 18 and removed from the fastener tape 20, and (iii) the coupling elements 14 are attached firmly to the fastener tape 20.

The present invention overcomes the above mentioned difficulty such as failure of removing the coupling elements away from the sewing thread or breaking of the sewing thread. This invention has therefore for its primary object the provision of the apparatus for forming space sections devoid of the coupling elements having a predetermined length in the elongate slide fastener chain having the interengaged coupling elements easily and properly.

SUMMARY OF THE INVENTION

Therefore, the present invention concerns a slide fastener making machine designed to produce space sections of suitable span devoid of coupling elements at predetermined intervals in the interengaged fastener chain composed of a pair of trains of continuous spiral coil sewed with a sewing thread to their respective fastener tape edges and a method for forming the same.

The apparatus of the present invention includes:

die means facing the fastener tapes for supporting the slide fastener chain horizontally;

punch means disposed on the coupling element side and being reciprocably movable toward the coupling element, said punch means having at the end surface a pair of laterally spaced apart cutting edges for cutting the upper portion of the pair of interengaged coupling elements at the connecting reversed portion side of the sewing thread and a gripping projection disposed centrally between the pair of the cutting edges for pressing the interengaged portions of the interengaged coupling elements;

ejector means disposed in the die means reciprocably movable toward the gripping projection of the punch means, the punch means being upwardly movable in response to the upward movement of the ejector means while the interengaged portion of the interengaged coupling elements is gripped between the edge of the ejector means and the gripping projection of the punch means; and means for holding the pair of fastener tapes in the area without the place where the pair of coupling elements are positioned.

As will be apparent from the above explanation of the construction of the present invention, the upper leg portion of the interengaged coupling element is cut at the connecting reversed portion side of the sewing thread over a distance corresponding to the space section devoid of the coupling elements by the pair of cutting edges whose longitudinal length is selected to be equivalent to the space section. That portion of the coupling elements which is cut by the cutting edges or the dismembered coil fragments are then securely held along their interengaged portion or over a portion inside the sewing threads by the gripping projection of the punch in conjunction with the ejector. The coupling elements are made of synthetic resin, and because of their elasticity, the dismembered coil fragments are suitably flattened by the gripping projection of the punch and the ejector so that they are released of the clinching tension of the sewing thread and get loose enough to be pulled out easily without significant resistance to their further upward or downward movement in synchronism with the fragments held between the punch and the ejector.

It will be easily understood from the above that removal of the dismembered coil fragments from their sewing threads can readily and perfectly be achieved without failure or without breaking the sewing threads to thereby provide the space sections of required span devoid of coupling elements at intervals in the slide fastener chain.

Operation of the apparatus for forming space sections constructed in accordance with the present invention will be described in more detail in conjunction with the drawings.

DESCRIPTION OF THE PREFERRED EMBODIMENTS

Figure 1:
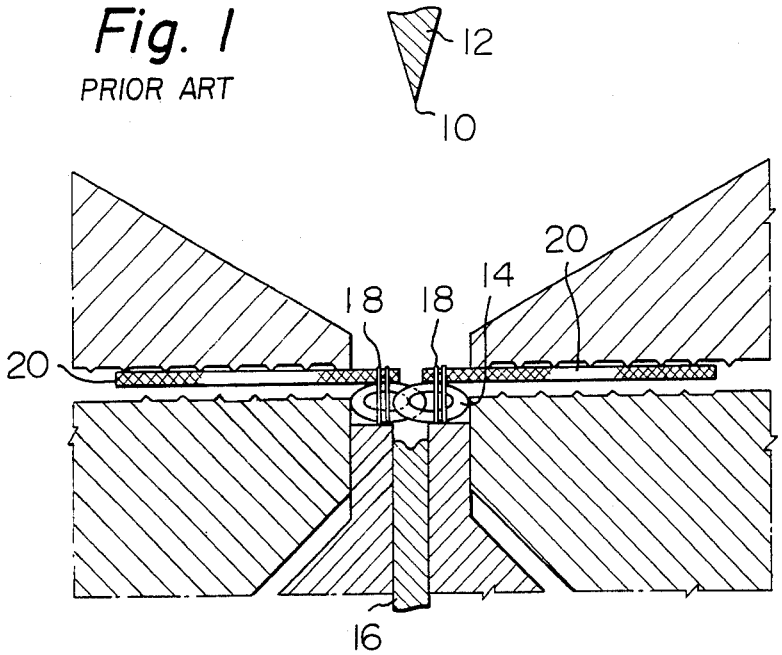
Fig. 1 PRIOR ART
FIGS. 1 to 4 are cross-sectional views of a conventional apparatus for forming space sections in different modes of operation.
Figure 2:
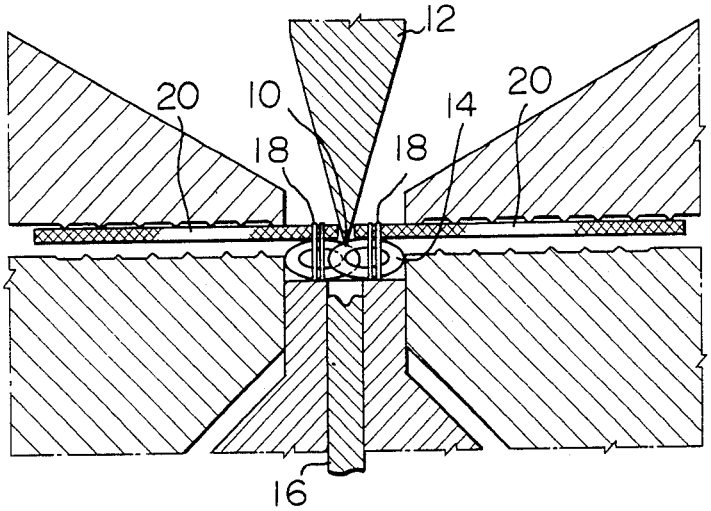
Fig. 2 PRIOR ART
Figure 3:
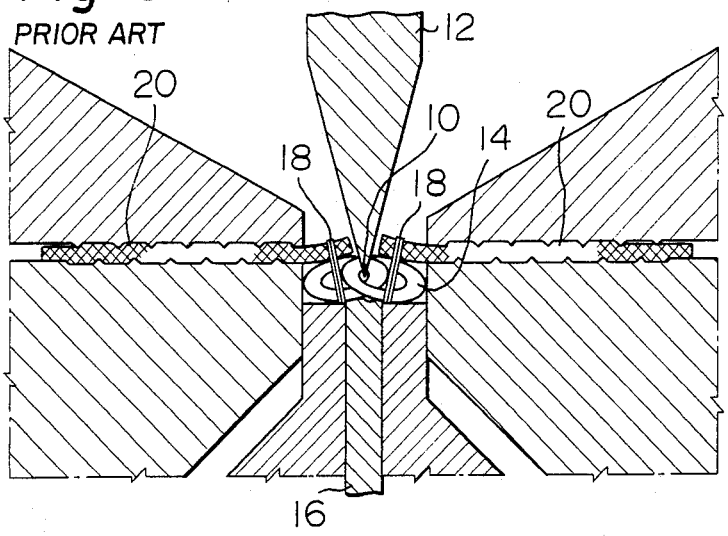
Fig. 3 PRIOR ART
Figure 4:
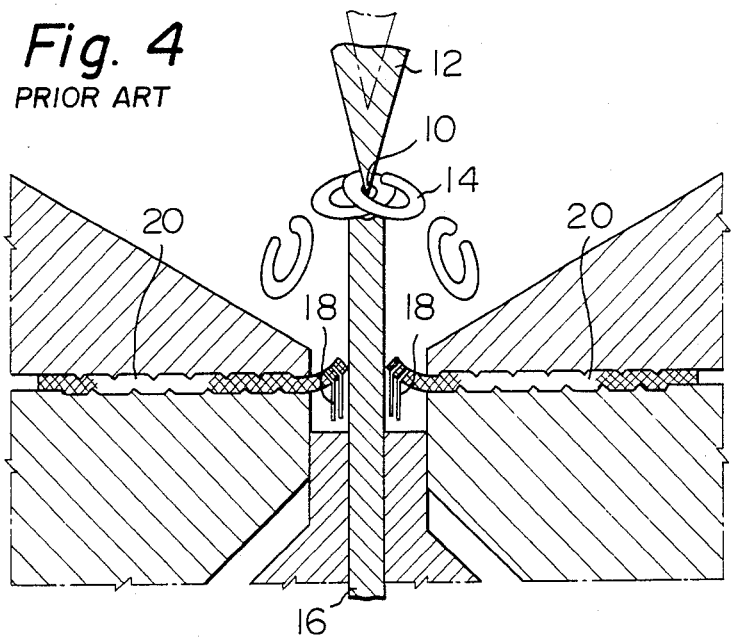
Fig. 4 PRIOR ART

Referring to the drawings, a slide fastener chain comprises a pair of fastener tapes 24,24 and a pair of continuous coupling elements 34,34, each of the coupling elements 34,34 being attached along each edge of the fastener tapes 24,24 by a sewing thread 32 and interengaged with the other coupling element 34. The coupling elements 34,34 are continuous spiral coil coupling elements of synthetic resin. Each of the coupling elements 34,34 comprises an interengaging head portion, a pair of upper and lower leg portions and a connecting reversed portion and the sewing thread 32 passes through the fastener tape 24 at the places between each pair of loops of the coupling elements 34,34.

The numerals 21 and 22 designate a die for supporting the slide fastener chain in horizontal condition thereon and a punch reciprocably disposed in the apparatus for forming space sections. Integrally connected to the punch 22 at its bottom end is a cutter comprising a pair of cutting edges 26 and 28 disposed substantially parallel with one another each having a blade length corresponding to the space sections of required span to be formed on each train of coupling elements 34,34 attached by the sewing threads 32 to the fastener tape 24 along its longitudinal edge. A gripping projection 30 is also provided on the bottom end of the punch 22 and extends in parallel with and centrally between the paired cutting edges 26 and 28. The cutting edges 26 and 28 are spaced far enough apart from each other to perform cutting on the trains of coupling elements 34,34 at either side of point **34*a* beyond or outside of the sewing thread 32 that secures each of the coupling elements 34,34 to the corresponding edge of the fastener tape 24. The gripping projection 30 is provided to seize or hold the portion of the coupling element trains which is to be cut by the cutting edges 26 and 28 along the interengaged portion in conjunction with a ejector 36 to be described in detail later. This gripping projection 30 is designed to protrude from the punch 22 high enough to press the upper leg portion adjacent to the interengaged interengaging head portions of the coupling elements 34,34 and flatten the dismembered coil fragments, cut off by the cutting edges 26 and 28, so as to release them of the clasping force the sewing thread 32 which might otherwise continue to tightly fasten these dismembered fragments to their tape edges. The gripping projection 30** may typically be of isosceles trapezoidal shape.

The ejector 36 is positioned opposite the punch 22 and is reciprocably disposed for vertical movement in the stationary die 21. This ejector 36 ascends toward and presses against the gripping porjection 30 of the punch 22, immediately after the cutting edges 26 and 28 have cut the train of coupling element 34 of the fastener tape 24. Then the gripping projection 30 flattens the dismembered coil fragments and holds them in conjunction with the ejector 36 securely so that these dismembered coil fragments are released of the clinching tension of the sewing thread 32. Further, the punch 22 ascends in response to the upward movement of the ejector 36 while the predetermined span of the dismembered coil fragments is hold by the ejector 36 and the gripping projection 30 of the punch 22 with each fragment being pressed and flattened. In the manner described above, the coupling elements cut off or dismembered coil fragments are removed from the sewing thread 32 and therefore from the fastener tape 24 easily.

Then the ejector 36 retracts to its original neutral position in the die 21 allowing these freed fragments to fall or to be disposed in a suitable manner.

Now according to FIGS. 5 to 8, which are views of the position of the principal parts at points during a normal operation, different modes of the operation will be described in full detail to give a clear idea of the mechanism of the present invention.

Figure 5:
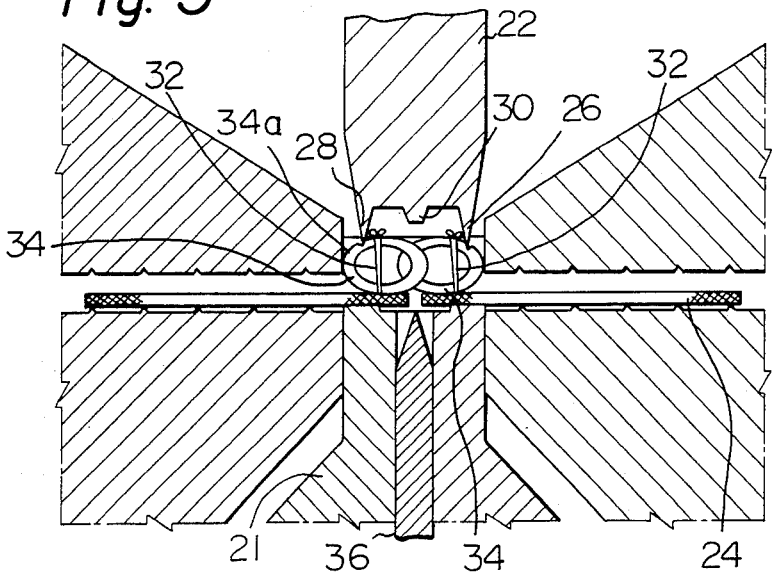
FIGS. 5 to 8 are cross-sectional views of an embodiment of the apparatus, according to the invention, for forming space sections in different modes of operation.

FIG. 5 depicts the first mode of operation where the punch 22 having at the lower end thereof a pair of parallel cutting edges 26 and 28 apart from each other descends from its upper position toward the fastener chain supported horizontally on the die 21 so that the interengaged coupling elements 34,34 begin to cut at the each of outer sides or the connecting reversed portion sides **34*a* of the sewing thread 32 by the cutting edge 26 or 28**.

Figure 6:
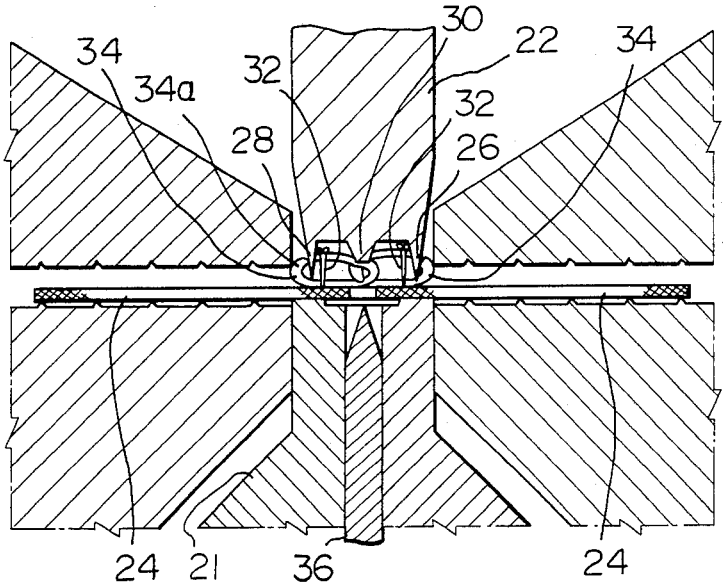

FIG. 6 illustrates the second mode of operation where the punch 22 has reached its bottom dead end of stroke after the trains of coupling element 34 have been cut over the space section of required span at a point **34*a* beyond the sewing thread 32. The blade length of each of the cutting edges 26 and 28 is selected to cut the corresponding train of coupling element 34 over a length equivalent to the space section of required span into a certain number of dismembered coil loops generally elliptical in shape, each loop cut at one point by the cutting edge. At this time, the gripping projection 30 of the punch 22 centrally disposed between the pair of the cutting edges 26 and 28 presses the point adjacent the interengaging head portion of the coupling elements 34,34 which have been cut off at the upper leg portions or the upper leg portion at the interengaging head portion side of the sewing thread 32 and flattens each of the dismembered coil fragments. Thereby, the flattened dismembered coil fragments or spiral coil loops get loose within the sewing threads 32**.

Figure 7:
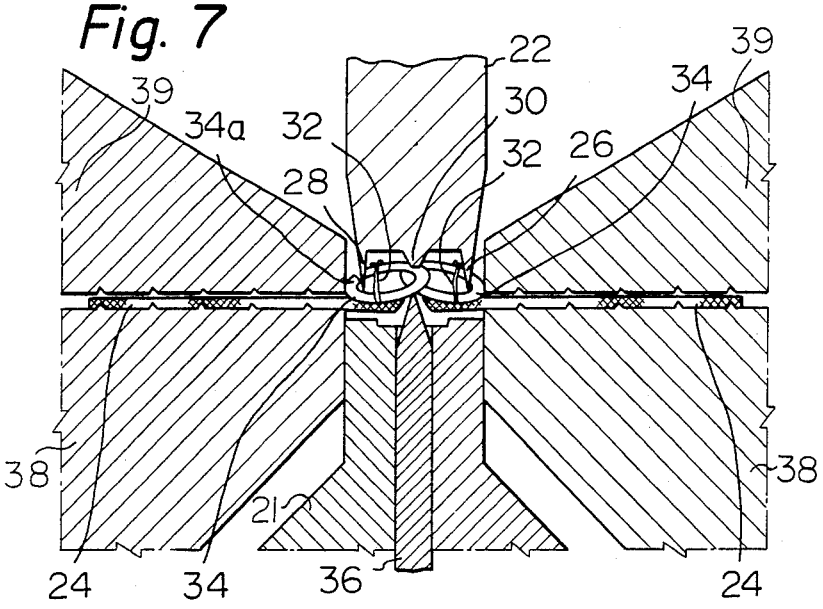

FIG. 7 shows the third mode of operation where the ejector 36 that is reciprocably disposed in the die 21 directly below the gripping projection 30 of the punch 22 moves upward to interpose the dismembered coil fragments between it and the gripping projection 30 to further flatten them. The paired fastener tapes 24 from which these dismembered coil fragments are separated are held stationary in a well known manner by a suitable mechanical holding means of the apparatus for forming the space sections. In this embodiment, the lower holding means 38 ascend in response to the upward movement of the ejector 36 and the elevation thereof stops at the point where the fastener tape 24,24 are hold by it in conjunction with the associated upper holding means 39.

Figure 8:
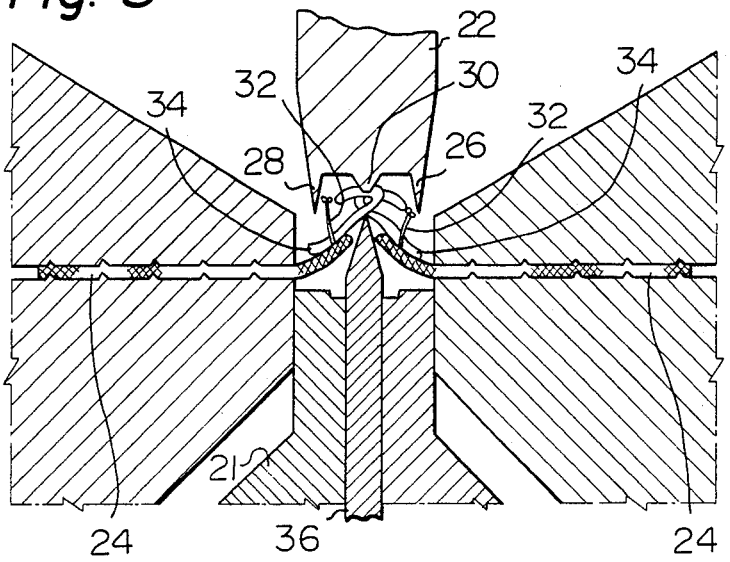

FIG. 8 is a view representing the fourth mode of operation where the punch 22 moves upwardly in response to the upward movement of the ejector 36 with the cut and flattened coupling elements held therebetween so as to draw the loops away from the sewing thread 32. During this operation, the fastener tapes 24,24 are held by the suitable holding means 38, 39. After the ejector 36 has reached its top dead end where cut and flattened coupling elements are able to be completely cleared off of the sewing thread, it retracts to its original position in the die 21 for the subsequent cycle of operation allowing the released dismembered coil fragments to fall or to be disposed in a suitable member.

From the above description it will be appreciated that the present invention fully achieves its objects of drawing the dismembered coil fragments from the sewing threads without failure or without breaking the thread, contributing much to increasing productivity.

It is to be understood that the invention is not limited to the precise construction shown in the attached drawings and described in the specification, but that changes are contemplated that readily fall within the spirit of the present invention as has been determined by the scope of the appended claims.

What is claimed is:

1. An apparatus for forming spaced sections at predetermined intervals in a slide fastener chain having a pair of interengaged coupling elements in the form of continuous coil in which the predetermined span of the coupling elements secured to a pair of fastener tapes by sewing threads is cut and the coupling elements are pulled out of the sewing threads and removed therefrom, said apparatus comprising:

die means confronting the fastener tapes for supporting the slide fastener chain horizontally;

punch means disposed on the coupling elements side of said tape and being reciprocably movable toward the coupling elements, said punch means having at the end surface a pair of laterally spaced apart cutting edges for cutting the lateral outer side upper leg portion of the pair of interengaged coupling elements at the connecting reserved portion side of the sewing thread and a gripping projection disposed centrally between the pair of the cutting edges for pressing the upper leg portions adjacent the interengaging head portions of the interengaged coupling elements to flatten out the coupling elements being cut;

ejector means disposed in the die means reciprocably movable toward the gripping projection of the punch means, said punch means being upwardly movable in response to the upward movement of the ejector means while the upper leg portions adjacent to the interengaging head portions of the interengaged coupling elements is gripped between the edge of the ejector means and the gripping projection of the punch means to draw the flattened, cut coupling elements away from the sewing thread; and means for holding the pair of fastener tapes.

2. An apparatus as set forth in claim 1 wherein the cutting edges extend beyond the gripping projection.

3. An apparatus as set forth in claims 1 or 2, wherein the coupling elements are made of synthetic resin or the like.

4. A method for forming space sections devoid of coupling elements having a predetermined length from an elongate slide fastener chain having a pair of interengaged coupling elements in the form of continuous coil, the method comprising steps of:

supporting the slide fastener chain horizontally;

cutting the lateral outer side upper leg portions of the interengaged coupling elements at each of the connecting reversed portion side of the sewing threads to separate the coupling elements into individual dismembered coil fragments;

pressing the upper leg portions adjacent to the interengaging head portions of the coupling elements to flatten the dismembered coil fragments and to release them from the clinching tension of the sewing threads;

pressing from the lower leg portion side the coupling elements adjacent to the interengaging head portions and holding each of the dismembered coil fragments at the confronting upper and lower leg portions adjacent the interengaging head portions so as to further flatten the coupling elements; and removing the cut, dismembered and flattened coil fragments from the tape by drawing the coupling elements away from the sewing threads.

* * * * *